United States Patent [19]

Nakano

[11] Patent Number: 5,044,128

[45] Date of Patent: Sep. 3, 1991

[54] MAGNETICALLY-POLISHING MACHINE AND PROCESS

[75] Inventor: Osamu Nakano, Tokyo, Japan

[73] Assignee: Priority Co., Ltd., Tokyo, Japan

[21] Appl. No.: 544,310

[22] Filed: Jun. 27, 1990

[51] Int. Cl.[5] ..... B24B 31/00

[52] U.S. Cl. ..... 51/313; 51/163.1; 51/164.1; 51/17; 51/7

[58] Field of Search ..... 51/163.1, 163.2, 164.5, 51/313, 317, 7, 17, 316, 129, 16, 3, 6, 164.1, 164.2

[56] References Cited

U.S. PATENT DOCUMENTS

| | | | |
|---|---|---|---|
| 2,787,854 | 4/1957 | Simjian | 51/7 |
| 2,880,554 | 4/1959 | Simjian | 51/7 |
| 3,695,934 | 10/1972 | Feldhaus | 51/317 |
| 3,848,363 | 11/1974 | Lovness et al. | 51/317 |

*Primary Examiner*—Frederick R. Schmidt

*Assistant Examiner*—Blynn Shideler

*Attorney, Agent, or Firm*—Jordan and Hamburg

[57] ABSTRACT

Articles are polished by a magnetically polishing machine having a high-speed rotatable magnet disc the top surface of which is divided by at least one diameter through the disc into alternating south- and north-polar zones, a fixed plate made of a nonmagnetic material and provided above the disc, a hollow cylindrical polishing vessel retainer provided above the fixed plate and including an elastic body made of a nonmagnetic material, the elastic body lining the inner cylindrical surface of the retainer, at least one polishing vessel made of a nonmagnetic material and removably retained in the retainer, and a device preventing the vessel from rotating. The machine and process of using the machine are applicable to an article made of a metal or a hard-plastic material and with a complicated configuration or a configuration which is desired to be as little deformed as possible.

14 Claims, 4 Drawing Sheets

MAGNETICALLY-POLISHING MACHINE AND PROCESS

BACKGROUND OF THE INVENTION

1. Field of the Invention

The present invention relates to a machine and process for magnetically polishing articles which are made of a metal, e.g., gold, silver, platinum, titanium or nickel or a hard plastic material and which have a complicated structure or are desired to be as least deformed by polishing as possible. It relates more particularly to a magnetically-polishing machine and process which can efficiently polish small metal products, e.g., finger rings, finger ring frameworks, slender and thin castings, watch second pointers, shafts, precision instrument parts and false teeth, and hard-plastic products, without deforming edges or complicated parts of the metal and hard-plastic products and without hardening the metals of the metal products and by means of which almost all powdered metal which is formed as a polishing waste can be recovered.

2. Description of the Related Art

Heretofore, precious metal finger rings and finger ring frameworks have been cast by molds and then hand polished. Even a skilled worker can hand polish only about 20 gold finger ring frameworks a day and even fewer when the frameworks are made of platinum, which is harder than gold. On the other hand, polished off powdered precious metal is scattered and, though most of this polished off powdered precious metal is recovered, a part thereof which amounts to about 5–6% of the total of the polished off powdered precious metal is lost. The about 5–6% amount of the polished off powdered precious metal is not negligible in cost.

On the other hand, a barreling machine has polished parts of a machine. Barreling essentially is a process which mechanically agitates polished articles and an abrasive together. When a portion of the abrasive enters recesses defined in the articles being polished that portion of the abrasive no longer can be agitated effectively since it is isolated from the rest of the abrasive.

In addition, the polished articles may collide with each other sufficiently to deform each other. This is especially the case in barreling polished articles each with a complicated and edged configuration. In addition, the barreling entails a drawback that metal pins provided on a barrel strike the metallic articles being polished to harden them.

High-speed polishing a finger ring by means of a polishing machine has been studied. However, since the configuration of the finger ring comprises a combination of irregular delicate curves, the configuration of the finger ring cannot fit a regular motion of the polishing machine, so that the polishing machine excessively and insufficiently polishes various parts of the finger ring. Thus, this high-speed polishing cannot develop delicate inherent curves of the configuration of the finger ring. Consequently, a finger ring has been considered unsuitable for mechanical polishing.

SUMMARY OF THE INVENTION

An objective of the present invention is to provide a polishing machine which can polish all of the surfaces of each of metal pieces and hard plastic products of any configurations with an equal torque so that the configuration of the metal pieces and hard plastic products remain exactly similar to original configurations thereof and which can completely recovery polished off powdered metal.

The present invention applies to polishing of a an article made of a metal, e.g, gold, silver, platinum, titanium or nickel, or a hard-plastic material which has a complicated configuration or which it is desired to deform as little as possible in polishing.

The present invention employs a high-speed rotatable magnet disc the surface of which is divided by at least one diametrical line into alternating south-polar sectors or zones and north-polar sectors or zones. The metal polishing machine includes an irrotatable polishing vessel made of a nonmagnetic material provided above the magnet disc with a spacing between the magnet disc and polishing vessel so that the magnet disc is out of contact with the bottom of the polishing vessel. Articles to be polished, magnetic or nonmagnetic abrasive particles and a liquid polishing assistant as well as permanent magnets as an agitator if the nonmagnetic abrasive particles are used are placed in the polishing vessel. The magnet disc is then rotated at high speed.

The magnetic abrasive particles provided in the polishing vessel above the magnet disc are thoroughly magnetized by the magnet disc to provide magnets in themselves. Since the magnet disc is rotated at high speed, magnetic fields created by the rotating magnet disc momentarily alternate so that the magnetic abrasive particles or the permanent magnets are inclined toward an approaching magnetic field created by the magnet disc and so that a different magnetic field then approaches the magnetic abrasive particles of the permanent magnets. Thus, the magnetic or nonmagnetic abrasive particles strike the articles to be polished to polish them.

In the present invention, since the articles being polished receive no torque, a spatial relationship therebetween cannot change so that the articles being polished cannot be deformed by collisions therebetween. In addition, the resulting polished off powdered metal cannot scattered and is retained in the polishing vessel, so that separating the polished off powdered metal from the abrasive particles can completely recover the polished off powdered metal.

A rotation of the magnet disc the surface of which is divided by the at least two diametrical lines into the alternating south- and north-polar zones creates the magnetic fields with south and north poles alternately exchanged.

The two diametrical lines through the magnet disc provide a total of four magnetically-polar zones as shown in FIG. 2. Three diametrical lines through the magnetic disc provide a total of six magnetically-polar zones. Each magnetically-polar zone comprises a matrix made of a nonmagnetic material, e.g., plastic material or aluminum and a few bar magnets made of a ferromagnetic material, e.g., Alnico-5 or samarium-cobalt and embedded in the matrix. The bar magnets of each south-polar zone are arranged so that the south pole of each bar magnet is up. On the other hand, the bar magnets of each north-polar zone are arranged so that the north pole of each bar magnet is down. Preferably, the bar magnets of each magnetically-polar zone are uniformly embedded in the matix of the magnetically-polar zone.

A 1,000–5,000 RPM high-speed rotation of the magnet disc alternates its magnetic fields. As shown in FIG. 2, the 1,000–5,000 RPM high-speed rotation of the magnet disc with the total of four magnetically-polar zones alternates the magnetic fields 4,000–20,000 times per minute.

The polishing machine includes a fixed plate made of a nonmagnetic material and mounted above the magnet disc with a predetermined clearance secured between the magnet disc and the fixed plate, and a rubber-elastic body made of a nonmagnetic material and surrounding the fixed plate, the fixed plate and rubber-elastic body together providing a polishing vessel retainer. This polishing vessel retainer receives the polishing vessel in an irrotatable position, while the magnet disc is rotated.

The polishing vessel is made of a nonmagnetic material, e.g., a plastic material and must be of a size to allow an article to be polished and permanent magnets to freely rotate on their own axes and so that the contents of the polishing vessel will not pour out during polishing. A cylindrical vessel which is detachable and easily washed and into and out of which the contents are easily taken for replacement preferably constitutes the polishing vessel. The polishing vessel more preferably has a head cover or cap.

Alternatively, a polishing vessel retainer plate including, e.g., a framework with an outer diameter larger than a bore diameter of the polishing vessel retainer may define one or more openings each of which can receive only one polishing vessel that has a flange or a slip or threaded cap with a diameter larger than that of the opening. The polishing vessel retainer may receive one or more polishing vessels.

A conventional means for retaining the polishing vessel in a fixed position may be employed. For example, the conventional retaining means may comprise an annular polishing vessel retainer plate the outer periphery of which includes a plurality of radially outwardly extending projections. In this case, the rubber-elastic body of the polishing vessel retainer may define a plurality of grooves to mate with the projections of the polishing vessel retainer plate. Alternatively, a part of a rubber-elastic top end of the polishing vessel retainer has a rodlike projection and on the other hand, the polishing vessel retainer plate may define a hole the edge surface of which fits the rodlike projection so that the polishing vessel retainer plate is fixed and thereby the polishing vessel is fixed by friction caused by the polishing vessel retainer plate. Thus, the polishing vessel is fixed by a conventional simple means.

The polishing vessel holds a great volume of magnetic abrasive particles and the abrasive particles are magnetized by the alternating magnetic fields created by the rotating magnet disc to provide alternately coupling and decoupling chains of the magnetic abrasive particles. Since the magnetic fields are momentarily turned over, the magnetic abrasive particles separate from each other, rotate, impact, are agitated and vibrate to not only polish the surfaces of the articles but also enter narrow recesses in the articles so as to polish the edge surfaces of the recesses. Thus, the overall surfaces of the articles are uniformly polished.

Materials for the abrasive particles comprise hard stainless steel, nickel steel, chromium steel and other like steel.

An antirust magnetic material of these material so hard as to polish a hard metal and hard plastic product may be preferably. The form of the abrasive particles is not limited to a particular form but is bar-shaped, angled, oval or spherical. The form and size of the abrasive particles are selected in accordance with the nature, the configuration and the degree to which an article is to be polished. Generally, the abrasive particles preferably are bar-shaped or spherical.

The width of the bar-shaped magnetic abrasive particles is 0.2–0.8 mm and preferably 0.4–0.6 mm. The length thereof is 1–7 mm and preferably 3–5 mm. The volume of abrasive particles depends on the material and configuration of the articles and the number thereof to be polished at one time. Generally, an apparent volume of abrasive particles is $\frac{1}{3}$–3 times and preferably essentially equals that of polished articles. A 1,000–5,000 RPM and about 1-hr rotation of the magnet disc provides a lustrous surface to the articles.

To enhance the luster of the lustrous surface, sperical abrasive particles are preferably employed. In this case, a nonmagnetic form of the spherical abrasive particle is employed, preferably of 0.5–4.0 mm diameter. The nonmagnetic abrasive particles require an agitator since they are incapable of rotation and agitation. The agitator is a permanent magnet. The shape of the agitator is not limited. However, the agitator should be quickly turned over in response to the alternating magnetic fields created by the magnet disc so as to agitate the nonmagnetic abrasive particles surrounding and in contact with the agitator. In particular, the agitator is preferably disc-shaped, since it produces a large agitating force when it is turned over on a point of the circumference thereof.

Ferrite, alnico and samarium-cobalt, which conventionally are materials for permanent magnets, are used as a material for the agitator. Alternatively, two small magnets respectively including outermost ends of south and north poles may sandwich a soft iron piece to creaate a high magnetic force. Generally, since these magneti materials are corrodible and brittle, they are coated with a nonmagnetic and corrosion-resistant material. Such coatings comprise tubes or films made of a plastic material, e.g, vinyl chloride or poly-propylene. To achieve the object of the present invention, a disc-shaped agitator may be of a ferritic disc of an about 1-cm diameter only the cylindrical surface of which is coated with a plastic material.

The volume of the nonmagnetic abrasive particles also depends on the material and configuration of the articles and the number thereof to be polished at one time. Generally, an apparent volume of the nonmagnetic abrasive particles is 1/6–1.5 times that of the articles to be polished. It is preferably 1/4 times to equal that of the articles to be polished. The number of the agitators also depends on the magnetic force, form and size of the agitators and should be so great that the agitators sufficiently agitate the non-magnetic abrasive particles. As the number of articles to be polished is decreased, the number of agitators is relatively decreased. However, it must be 5–87 even if the number of polished articles is one.

The polishing vessel contains a liquid polishing assistant comprising small amounts of a surfactant, a lustering agent, a rust preventive, etc.

DESCRIPTION OF THE PREFERRED EMBODIMENT

The preferred embodiment of the present invention will be described with reference to FIGS. 1-6.

Figure 1:
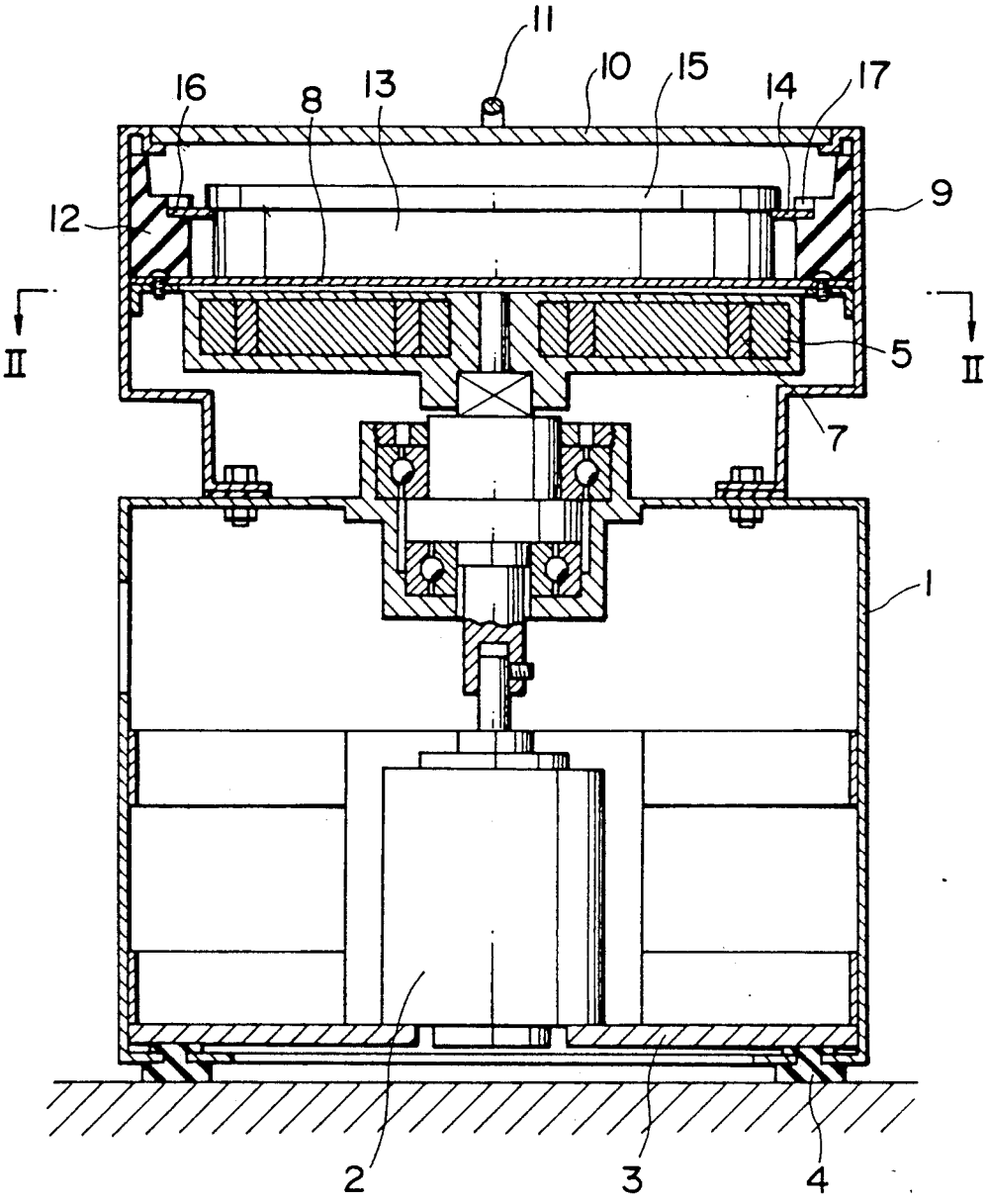
FIG. 1 is a longitudinal section through a main part of a magnetically-polishing machine of the present invention.
Figure 2:
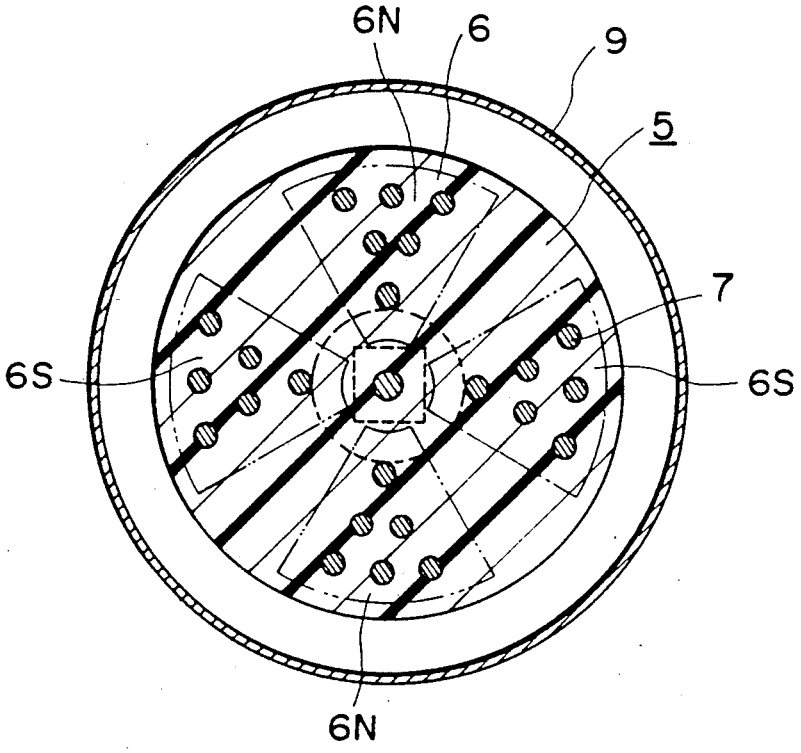
FIG. 2 is an end section taken along the line II—II in FIG. 1.

A motor casing indicated at 1 contains an A.C. motor 2. A bottom plate of the motor casing 1 indicated at 3 has a plurality of feet 4. An inverter (not shown) provided between a power source (not shown) and the motor 2 controls the rotational speed of the motor 2. The motor 2 direct drives a magneti disc 5. The matrix of the magnet disc 5 is made of a nonmagnetic material, e.g., aluminum or a plastic material. As shown in FIG. 2 the magnet disc 5 comprises an even number of magnetically-polar zones 6. South polar zones 6S and north polar zones 6N alternating at intervals circumferentially of the magnet disc 5 may include a permanent magnet having two poles in the upper and lower surfaces of the magnet disc 5. In the present embodimen, each magnetically-polar zone 6 includes six bar ferromagnets 7 of Alnico-5 each having different magnetic poles at the opposite ends and embedded in the matrix of that magnetically-polar zone 6 so that the same poles at the opposite ends thereof the bar magnets 7 appear in the same surface of that magnetically-polar zone 6.

A fixed plate indicated at 8 is provided above the magnet disc 5 with a clearance defined between the fixed plate 8 and magnet disc 5 and is made of a nonmagnetic material, e.g., aluminum. A cylindrical polishing casing indicated at 9 has a cap 10. The cap 10 has a knob 11. A lining 12 made of a nonmagnetic elastic material, e.g., a rubber-elastic material covers the inner cylindrical surface of the polishing casing 9 above the fixed plate 8 and provides a main part of a polishing vessel retainer. A polishing vessel is indicated at 13. A polishing vessel retainer plate indicated at 14 fixes the polishing vessel 13 to the polishing vessel retainer. A polishing vessel cap is indicated at 15. A plurality of radially outwardly extending projections indicated at 16 fix the polishing vessel retainer plate 14 to the rubber-elastic lining 12. A plurality of recesses indicated at 17 receive the projections 16 with a snug fit.

Figure 3:
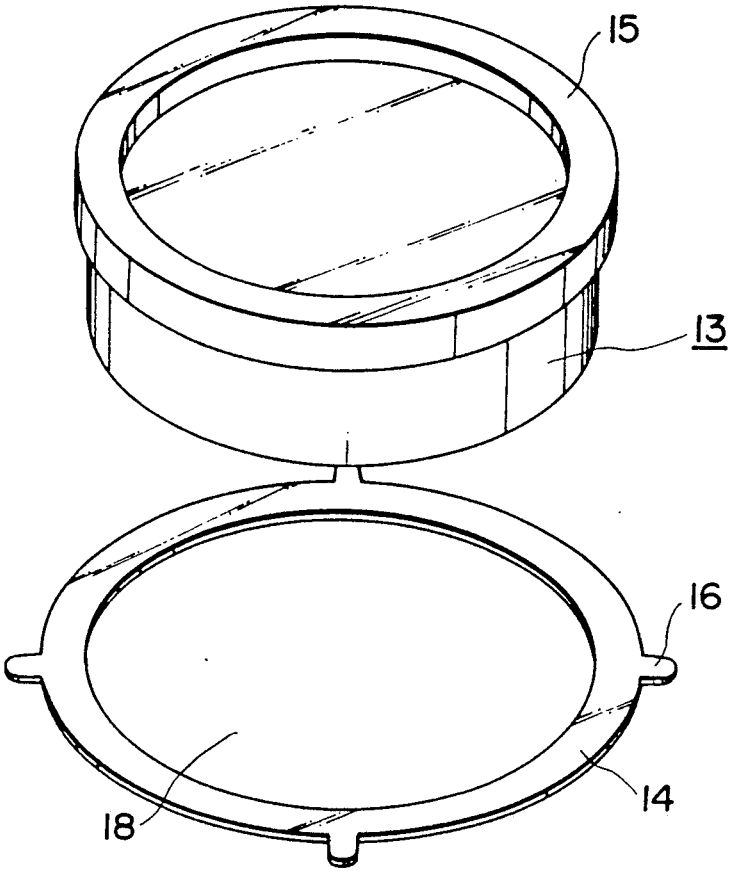
FIG. 3 is an exploded persepceive view of an assembly of a polishing vessel retainer plate and a polishing vessel to be retained therewithin.
Figure 4:
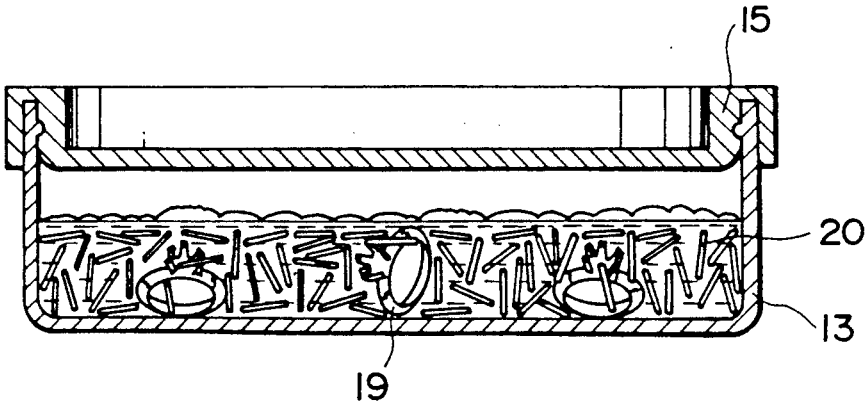
FIG. 4 is a radial section through the polishing vesse, illustrating a polished condition of contents in the polishing vessel.
Figure 5:
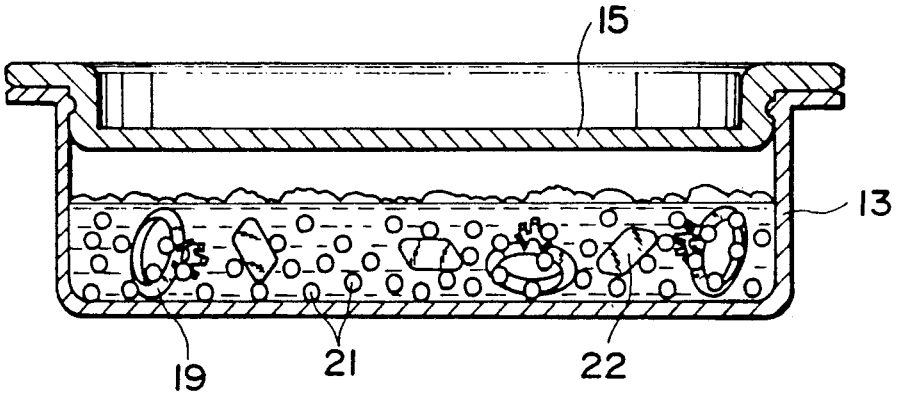
FIG. 5 is a radial section through the polishing vessel, illustrting a polished condition of different contents in the polishing vessel.

As shown in FIGS. 3 and 4, the polishing vessel retainer plate 14 defines a hole 18 sufficiently large to accommodate the polishing vessel 13.

In polishing, 50 platinum frameworks cast for diamond rings as the articles to be polished 19, a great volume of magnetic abrasive particles 20 and a great volume of a liquid polishing assistant 21 were placed in the polishing vessel 13 and then the cap 15 closed the polishing vessel 13. The magnetic abrasive particles 20 consisted of magnetic stainless steel bars with each a 0.5-mm width and a 4-mm length. As shown in FIGS. 3 and 4, the polishing vessel 13 was then mounted within the hole 18 defined in the polishing vessel retainer plate 14, and the resulting assembly of the polishing vessel 13 and polishing vessel retainer plate 14 was mounted within the polishing vessel retainer of the polishing machien so that the projections 16 of the polishing retainer plate 14 fitted the recesses 17 defined in the rubber-elastic lining 12 in order to fasten the polishing vessel 13.

The cap 10 which had closed the polishing casing 9 was latched and the magnet disc 5 was then rotated at 2,000 RPM for about 1 hr. The liquid polishing assistant 21 foamed but not so as to overflow the polishing vessel 13 and the magnetic abrasive particles 20 were agitated by being turned over but the articles 19 were only slowyl moved in a direction opposite to the rotational direction of the magent disc 5 without substantially changing relative spatial positions therebetween. After a 1-hr polishing, not only the overall outer cylindrical surface but also the overall inner cylindrical surface of each of the diamond ring platinum frameworks were uniformly polished to produce the inherent metallic luster of platinum suitable for platinum frameworks for diamong rings.

Figure 6:
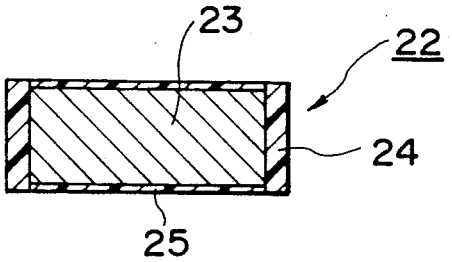
FIG. 6 is a section through an agitator.

Then, the articles 19 which had been rough polished were trnsferred into a second polishing vessel 13 just like the first polishing vessel 13. A great volume of nonmagnetic abrasive spheres 20 each with a 2-mm diameter made of nonmagnetic stainless steel and a suitable amount of liquid polishing assistant 21 were also placed in the second polishing vessel 13. 30 of agitators 22 each made of a disc-shaped ferritic magnet 23 of an about 1-cm diameter were placed in the second polishing vessel 13 since the nonmagnetic abrasive particles 20 could not produce an agitating force. As shown in FIG. 6, each of the agitators 22 comprised a disc-shaped ferritic magnet 23, a thicker-walled tube 24 made of polyvinylchloride and coating the cylindrical surface of each disc-shaped ferritic magnet 23, and thinner-walled discs also made of polyvinylchloride and coating the topside and underside of each disc-shaped ferritic magnet 23. A disc-shaped agitator constituted of disc-shaped ferritic magnet with a single polyvinylchloride tube coating the cylindrical surface thereof also essentially achieved the objective of the presented invention.

A rotation of the magnetic disc 5 at 3,000 RPM for 1 hr violently turned the agitators 22 thereby to agitate the non-magnetic abrasive particles 20, so that not only outermost surfaces but also recessed surfaces of the platinum frameworks for diamong rings were well polished. The polishing of the platinum frameworks for diamond rings performed by the nonmagnetic abrasive particles provided the same delicacy and luster as a finishing polishing so that a diamond could be directly mounted to each of these platinum frameworks for diamond rings.

The polishing machine of the present invention entailed a production of powdered precious metal all of which was retained in the second polishing vessel. The liquid polishing assistant in the second polishing vessel from which the polished articles and abrasive particles had been eliminated retained almost all of the powdered precious metal which was essentially completely recovered.

What is claimed is:

1. A magnetically-polishing machine, comprising:

a high-speed rotatable magnet disc the top surface of which is divided by at least one diameter through said magnet disc into alternating south-polar zones and north-polar zones;

a fixed plate made of a nonmagnetic material and provided above said magnet disc;

a hollow cylindrical polishing vessel retainer provided above said fixed plate and including an elastic body made of a nonmagnetic material, the elastic body lining the inner cylindrical surface of said polishing vessel retainer;

at least one polishing vessel made of a nonmagnetic material and removably retained in said polishing vessel retainer; and means for preventing said polishing vessel from rotating.

2. A magnetically-polishing machine recited in claim 1, wherein each of the south-polar zones includes a first matrix made of a nonmagnetic material and a plurality of first bar magnets each with the opposite ends producing different magnetic poles, the first bar magnets being embedded in the matrix so that the south pole of each of the first bar magnets is positioned in the top surface of said magnet disc, and each of the north-polar includes a second matrix made of a nonmagnetic material and plurality of second bar magnets each with the opposite ends producing different magnetic poles, the second bar magnets being embedded in the second matrix so that the north pole of each of the second bar magnets is positioned in the top surface of said magnet disc.

3. A magnetically-polishing machine as recited in claim 2, further comprising:

annular polishing vessel retainer framework defining a hole to accommodate said polishing vessel and having an outer diameter larger than the bore diameter of said polishing vessel retainer, said polishing vessel having a flange engaging said polishing vessel retainer framework so as not to fail from the edge surface of the hole.

4. A magnetically-polishing machine as recited in claim 2, further comprising:

an annular polishing vessel retainer framework defining a hole to accommodate said polishing vessel and having an outer diameter larger than the bore diameter of said polishing vessel retainer, said polishing vessel having a head cover with a diameter larger than the diameter of the hole so that the head cover cannot fall from the edge surface of the hole.

5. A magnetically-polishing machine as recited in claim 1, further comprising:

an annular polishing vessel retainer framework defining a hole to accommodate said polishing vessel and having an outer diameter larger than the bore diameter of said polishing vessel retainer, said polishing vessel having a flange engaging said polishing vessel retainer framework so as not to fail from the edge surface of the hole.

6. A process for magnetically-polishing an article by means of a magnetically-polishing machine, the machine comprising a high-speed rotatable magnet disc the top surface of which is divided by at least one diameter through the magnet disc into alternating south-polar zones and north-polar zones, a fixed plate made of a nonmagnetic material and provided above the magnet disc, a hollow cylindrical polishing vessel retainer provided above the fixed plate and including an elastic body made of a nonmagnetic material, the elastic body lining the inner cylindrical surface of the polishing vessel retainer, at least one polishing vessel made of a non magnetic material and removably retained in the polishing vessel retainer, and means for preventing the polishing vessel from rotating, the process comprising placing in the polishing vessel at least one article to be polished, an abrasive in the form of pieces of a magnetic metal having dimensions of at least 0.2 mm and a liquid polishing assistant with a small amount of a surfactant; then fastening the polishing vessel; and then agitating the abrasive without translationally moving the abrasive by rotating the magnetic disc at high speed.

7. A process of magnetically-polishing as recited in claim 6, wherein the abrasive comprises bars made of magnetic stainless steel.

8. A process for magnetically-polishing as recited in claim 7, wherein each of the bars is a solid cylinder having a 0.2–0.8 mm diameter are a 1–7 mm length.

9. A process for magnetically-polishing as recited in claim 6, wherein the rotational speed of the magnetic disc is 1,000–5,000 RPM.

10. A process for magnetically-polishing a high-speed rotatably magnetic disc the top surface of which is divided by at least one diameter through the magnet disc into alternating south-polar zones and north-polar zones, a fixed plate made of a nonmagnetic material and provide above the magnet disc, a hollow cylindrical polishing vessel retainer provided above the fixed plate and including an elastic body mad of a nonmagnetic material, the elastic body lining the inner cylindrical surface of the polishing vessel retainer, at least one polishing vessel made of a nonmagnetic material and removably retained in the polishing vessel retainer, and means for preventing the polishing vessel from rotating, the process comprising placing in the polishing vessel at least one article to be polished, an abrasive in the form of pieces of a nonmagnetic metal having dimensions of at least 0.5 mm, a magnet agitator having a dimension of about 1 cm and a liquid polishing assistant with a small amount of a surfactant; then fastening the polishing vessel; and then agitating the abrasive without translationally moving the abrasive by rotating the magnet disc at high speed.

11. A process for magnetically-polishing as recited in claim 10, wherein the abrasive comprises spheres made of nonmagnetic stainless steel.

12. A process magnetically-polishing as recited in claim 11, wherein each of the spheres has a 0.5–4.0 mm diameter.

13. A process for magnetically-polishing as recited in claim 10, wherein the magnetic agitator comprises a disc-shaped permanent magnet having a cylindrical surface coated with a plastic material.

14. A process for magnetically-polishing as recited in claim 10, wherein the rotational speed of the magnetic disc is 1,000–5,000 RPM.

* * * * *